US006597100B2

(12) United States Patent
Kobayashi

(10) Patent No.: US 6,597,100 B2
(45) Date of Patent: Jul. 22, 2003

(54) MAGNETIC SHIELD FOR A CATHODE RAY TUBE

(75) Inventor: Kenji Kobayashi, Singapore (SG)

(73) Assignee: Sony Electronics (Singapore) PTE LTD, Singapore (SG)

( * ) Notice: Subject to any disclaimer, the term of this patent is extended or adjusted under 35 U.S.C. 154(b) by 26 days.

(21) Appl. No.: 09/871,095

(22) Filed: May 31, 2001

(65) Prior Publication Data

US 2002/0003392 A1 Jan. 10, 2002

(30) Foreign Application Priority Data

Jun. 1, 2000 (SG) ..... 200003048-6

(51) Int. Cl.[7] ..... H01J 31/00

(52) U.S. Cl. ..... 313/477 R; 313/402; 313/404; 313/433; 313/437; 313/479

(58) Field of Search ..... 313/402, 404, 313/406, 407, 479, 313, 436, 433, 434, 440

(56) References Cited

U.S. PATENT DOCUMENTS

| | | | | |
|---|---|---|---|---|
| 3,935,496 | A | * | 1/1976 | Gijrath |
| 4,385,256 | A | * | 5/1983 | Tokita et al. |
| 4,387,321 | A | * | 6/1983 | Gijrath et al. |
| 4,943,755 | A | | 7/1990 | Toshiyasu et al. |
| 6,459,194 | B1 | * | 10/2002 | Akita |

FOREIGN PATENT DOCUMENTS

| | | |
|---|---|---|
| GB | 1 171 138 | 11/1969 |
| GB | 1 327 364 | 8/1973 |
| JP | 261369/1998 | 9/1998 |

* cited by examiner

*Primary Examiner*—Nimeshkumar D. Patel
*Assistant Examiner*—German Colón
(74) *Attorney, Agent, or Firm*—Frommer Lawrence & Haug LLP; William S. Frommer; Leonard J. Santisi

(57) ABSTRACT

A magnetic shield (20) for a cathode ray tube includes a body portion and a skirt section (21) around the body portion. The skirt section (21) has a skirt portion (23) having a free edge (25) and being connected to the body portion at its opposite edge (26), wherein the length of the free edge (25) is less than the length of the opposite edge (26).

6 Claims, 2 Drawing Sheets

MAGNETIC SHIELD FOR A CATHODE RAY TUBE

The invention relates to a magnetic shield for a cathode ray tube.

All monitors or televisions which use a cathode ray tube (CRT) have an auto-degaussing feature which is activated every time the CRT is switched on. Degaussing of the CRT is necessary when, for example, the CRT moves locations to compensate for variations in the Earth's magnetic field between different geographical locations.

The CRT includes a color identification device commonly referred to as the aperture grill assembly and a magnetic shield which is fixed to the Aperture grill assembly, normally by spot welding of a skirt, which extends around the periphery of the magnetic shield, to the edges of the aperture grill assembly. However, when a CRT is degaussed, there is a tendency for the edge of the skirt to vibrate and strike the aperture grill assembly. This causes a ringing sound which is audible and therefore, undesirable. In addition, there is also a tendency for the magnetic shield to ring if it is used in a television, as certain sound frequencies may also cause vibration of the skirt and therefore, also cause ringing.

The vibration could be reduced by reducing the degaussing force or by reducing the size of the skirt. However, if the degaussing force is reduced, it is not possible to degauss the CRT properly. In addition, if the end of the skirt around the magnetic shield is reduced, this reduces the amount of magnetic shielding.

This is also undesirable as if the magnetic shield is reduced, the CRT is more vulnerable to the effects of terrestrial magnetic fields. Therefore, if the CRT is not properly-shielded, the electron beam may be influenced by the terrestrial field and may cause the electron beam to strike the wrong section of the screen and distort the image. For example, the electron beam may strike a blue phosphorous region instead of a red phosphorous region, and so cause color distortion.

In accordance with the present invention, a magnetic shield for a cathode ray tube comprises a body portion and a skirt section around the body portion, the skirt section comprising a skirt portion having a free edge and being connected to the body portion at its opposite edge, wherein the length of the free edge is less than the length of the opposite edge.

Preferably, the edges of the skirt portion between the opposite edge and the free edge are at an oblique angle to the opposite edge and the free edge such that the skirt portion tapers from the opposite edge to the free edge.

Alternatively, the edges between the opposite edge and the free edge may comprise a number of stepped edges such that the free edge has a length less than the length of the opposite edge.

In a further example of the invention, the edges extending from the opposite edge to the free edge may be curved or have any other suitable shape.

In accordance with a second aspect of the invention, a cathode ray tube assembly comprises aperture grill assembly coupled to a magnetic shield structure, the magnetic shield structure being in accordance with the first aspect of the present invention.

Preferably, the separation of the grill assembly and the free edge is greater than $$\frac{FL^3}{3EI},$$

where F is a force applied to the skirt section, L is the maximum distance from the coupling of the skirt portion to the aperture grill assembly to the free edge, E is the Young's modulus of the skirt portion and I is the moment of inertia of the skirt portion. For example, the force may be generated by degaussing, sound or any other means.

Typically, the length of the free edge is preferably less than 20 mm, and most preferably less than 15 mm.

An example of a magnetic shield in accordance with the invention will now be described with reference to the accompanying drawings, in which.

Figure 1:
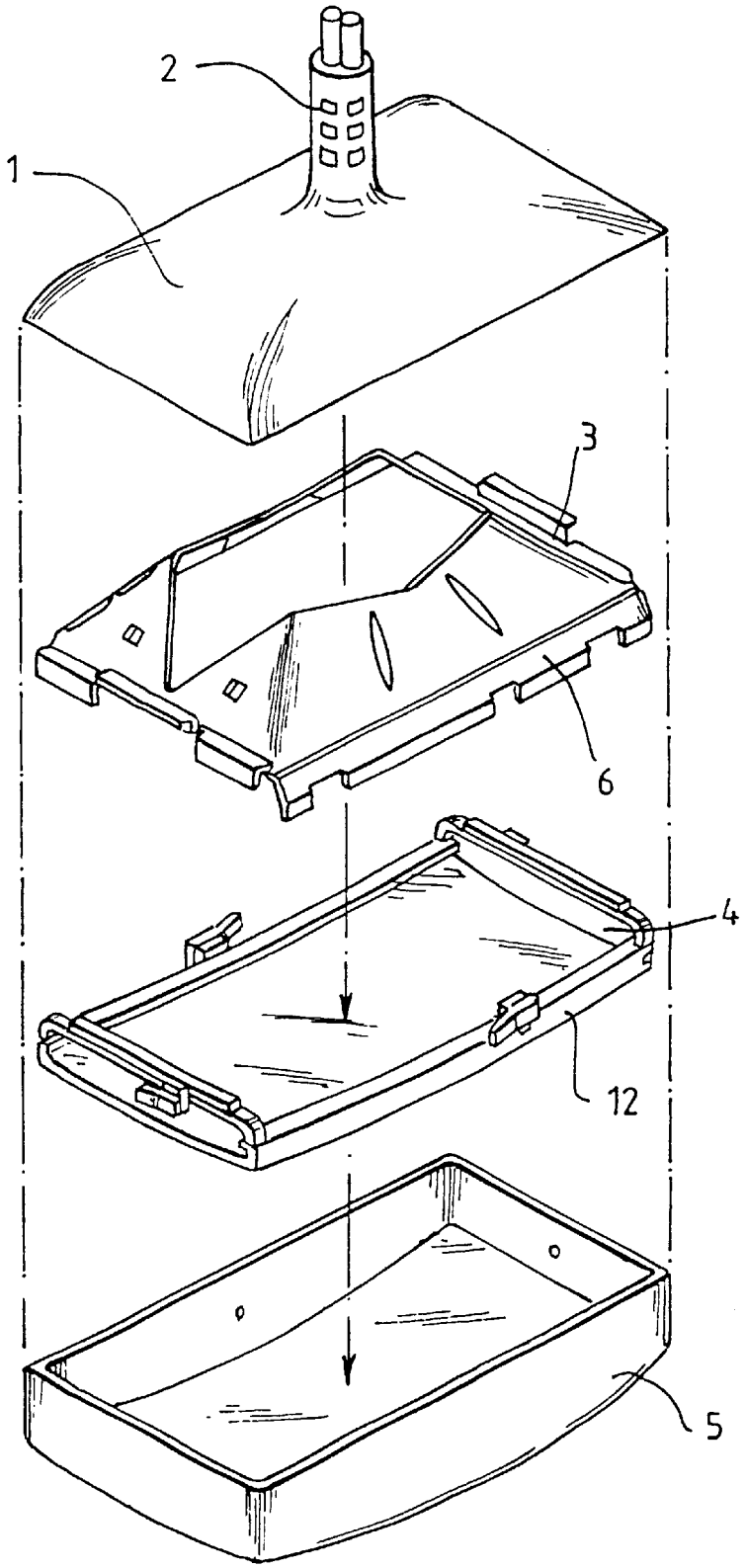
FIG. 1 is an exploded schematic view of a conventional cathode ray tube assembly.

FIG. 1 shows an exploded view of a conventional cathode ray tube assembly which comprises a funnel sectional 1 having an electron gun 2, an internal magnetic shield structure 3 having a skirt 6, a color identification structure (commonly known as an aperture grill assembly) 4 and a panel section 5.

Figure 2:
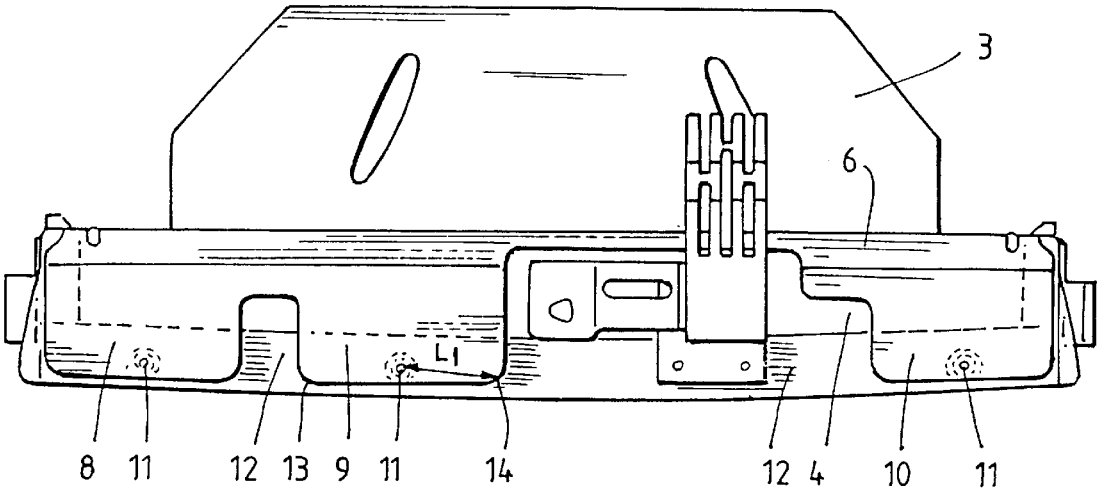
FIG. 2 is a side view of conventional magnetic shield mounted on an aperture grill assembly.

Typically, the magnetic shield structure 3 is mounted on the aperture grill assembly 4 such that the skirt 6 extends around an outside edge 12 of the aperture grill assembly 4, as shown in FIG. 2. The skirt 6 is spot welded to the edge 12 of the aperture grill at discreet locations to permanently attach the magnetic shield structure 3 to the aperture grill assembly 4. The skirt 6 has a number of skirt portions 8, 9, 10, and each of the skirt portions 8, 9, 10 are attached to the edge 12 of the aperture grill assembly 4 by spot welds 11.

During use of the conventional cathode ray tube using the conventional magnetic shield 3, during degaussing and at certain sound frequencies, corners 13, 14 of the skirt portion 9 vibrate and cause a ringing sound by striking against the edge 12 of the aperture grill assembly 4.

Figure 3:
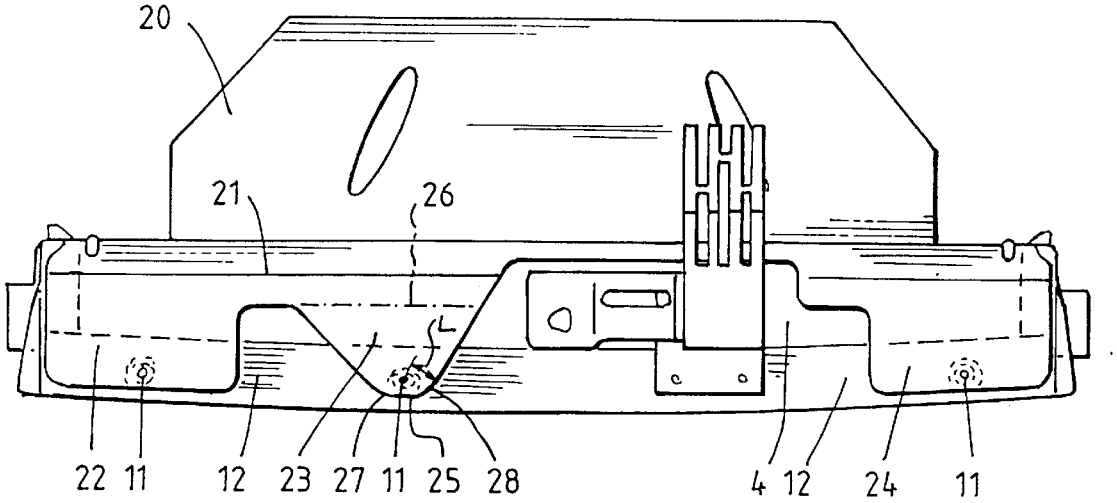
FIG. 3 is a side view of magnetic shield in accordance with the invention mounted on an aperture grill assembly.

FIG. 3 shows a side view of an aperture grill 4 having a magnetic shield structure 20 in accordance with the invention, mounted on the aperture grill assembly 4. The magnetic shield structure 20 includes a skirt 21 comprising three skirt portions 22, 23, 24 which are fixed to the edge 12 of the aperture grill assembly 4 by spot welds 11. The skirt portion 23 is different from the skirt portion 9 as the length of free edge 25 is less than the length of the opposite edge 26 which is the imaginary edge at which the skirt portion 23 joins the main section of the skirt 21. Due to the reduced length of the free edge 25 compared with the opposite edge 26, corners 27, 28 of the free edge 25 are closer to the weld 11 and therefore, are less likely to vibrate and to strike the edge 12 of the aperture grill assembly 4 and cause ringing.

Figure 4:
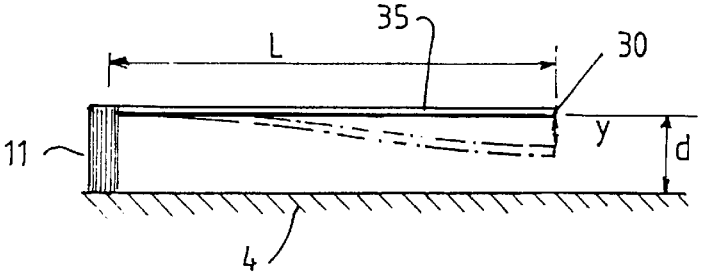
FIG. 4 is a schematic cross-sectional view of a portion of an aperture grill assembly and a portion of a magnetic shield.

This can be explained by reference to FIG. 4 which shows a schematic cross-sectional view along a line from the spot weld 11 to a corner 30 of a free edge of a skirt portion most remote from the spot weld 11. If y is the displacement of the corner 30 in a direction towards the edge 12 of the aperture grill assembly 4, it can be shown that the amplitude of vibration y of the corner 30 is as follows:

$$y = \frac{FL^3}{3EI}$$

Where F=the force applied to the corner 30, L is the distance from the corner 30 to the spot weld 11, E is the Young's modulus of the skirt portion 35 and I is the moment of inertia of the skirt portion 35. Therefore, in order to prevent the corner 30 striking the edge 12 due to an applied force F, the amplitude of vibration, y must be less than d, which is the separation of the edge 12 and the skirt portion 35 with no applied force F. Therefore, it follows that $$d > \frac{FL^3}{3EI}$$

In fact when the calculations are made, it is found that the conventional magnetic shield 3 has a skirt portion 9 for which d is less than $$\frac{FL^3}{3EI}.$$

For a typical magnetic shield structure, it is found that the length L from the spot weld 11 to the most remote corner 30 should be less than 20 mm, and preferably less than 15 mm.

An advantage of the invention is that it permits the length of the free edge of a skirt portion of a magnetic shield to be reduced to minimise the possibility of the corners of the free edge striking edge 12 of the aperture grill assembly 4, while still maintaining the overall area of the skirt portion 4 at a sufficiently surface are to provide effective magnetic shielding to the electron beam emitted by the electron gun 2.

What is claimed is:

1. A magnetic shield for a cathode ray tube comprising a body portion and a skirt section around the body portion, the skirt section comprising a skirt portion having a free edge and being connected to the body portion at its opposite edge, wherein the length of the free edge is less than the length of the opposite edge and is less than 20 mm.

2. A magnetic shield according to claim 1, wherein the edges of the skirt portion between the opposite edge and the free edge are at an oblique angle to the opposite edge and the free edge.

3. A magnetic shield according to claim 1, wherein the edges between the opposite edge and the free edge may comprise a number of stepped edges.

4. A magnetic shield assembly according to claim 1, wherein the length of the free edge is less than or equal to 15 mm.

5. A cathode ray tube assembly comprising an aperture grill assembly coupled to a magnetic shield structure, the magnetic shield structure being in accordance with claim 1.

6. An assembly according to claim 5, wherein the separation of the grill assembly and the free edge is greater than $$\frac{FL^3}{3EI},$$

where F is a force applied to the skirt section, L is the maximum distance from the coupling of the skirt portion to the aperture grill assembly to the free edge, E is the Young's modulus of the skirt portion and I is the moment of inertia of the skirt portion.

* * * * *